US006267686B1

(12) United States Patent
Legacie, Jr.

(10) Patent No.: US 6,267,686 B1
(45) Date of Patent: Jul. 31, 2001

(54) POOL STICK FOR BILLIARDS TRAINING

(76) Inventor: Douglas W. Legacie, Jr., 2760 Robertson Rd. #60, Casper, WY (US) 82604

( * ) Notice: Subject to any disclaimer, the term of this patent is extended or adjusted under 35 U.S.C. 154(b) by 0 days.

(21) Appl. No.: 09/263,377

(22) Filed: Mar. 5, 1999

(51) Int. Cl.[7] ..... A63D 15/08
(52) U.S. Cl. ..... 473/44
(58) Field of Search ..... 473/44–49

(56) References Cited

U.S. PATENT DOCUMENTS 4,423,867 * 1/1984 Wise ..... 473/44

* cited by examiner

*Primary Examiner*—Mark S. Graham

(74) *Attorney, Agent, or Firm*—Mallinckrodt & Mallinckrodt; Brian R. Rayve

(57) ABSTRACT

A pool stick for training billiards players to not rotate the pool stick during a pool stroke. The pool stick comprises an elongate body and an endmost shooting tip. A guide portion of the body adjacent the shooting tip is laterally offset from the shooting tip and from the remainder of the body. When the pool stick is slidingly supported by a frontmost hand of the pool player on the guide portion and by a rearmost hand gripping the body opposite the guide portion, any rotation of the pool stick during a pool stroke occurs along an actual axis which extends from a pair of movable points, one in the rear body portion at the rearmost hand and one in the guide portion at the frontmost hand, which actual axis does not pass through the shooting tip. This allows a pool player to visually detect any rotational movement by observing lateral rotational movement of the shooting tip about such actual axis relative to the guide portion and to other references such as a billiard ball.

3 Claims, 2 Drawing Sheets

POOL STICK FOR BILLIARDS TRAINING

BACKGROUND OF THE INVENTION

1. Field

Figure 5:
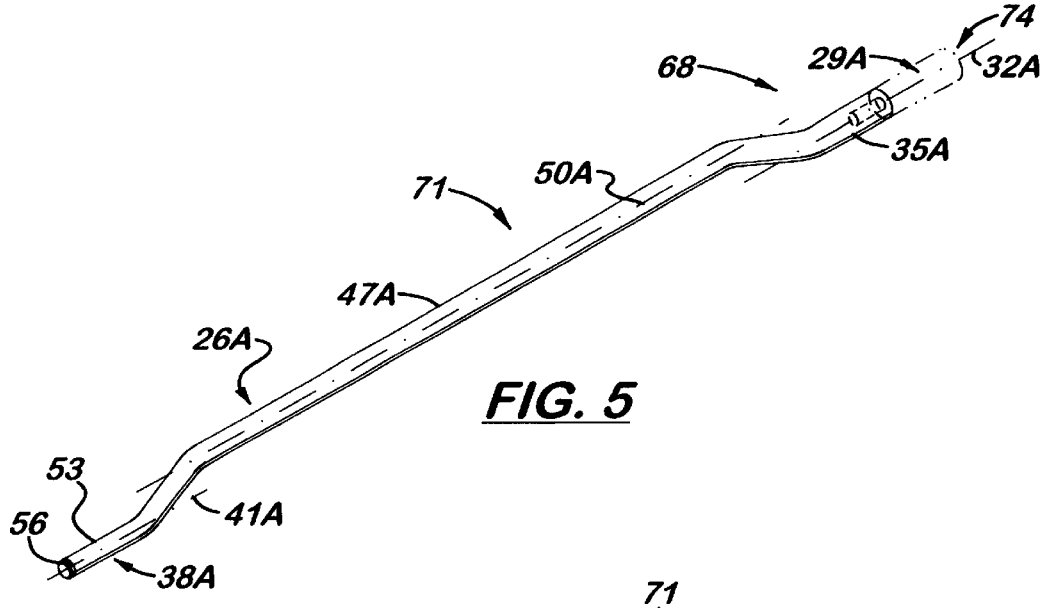

The invention is in the field of training aids and pool sticks for playing billiards.

2. State of the Art

Shooting billiards, or pool as it is commonly called, is a very popular pastime with people in this country and in other parts of the world. While there are many people who play pool as a leisure activity, pool requires a great deal of skill in order to play well as evidenced by the proficiency of professional pool players. A pool player must not only determine the correct angles at which to hit the billiard balls to go into a pocket sometimes including contacting the side bumpers, but must also aim the pool stick and stroke at the cue ball such that the tip of the pool stick contacts the cue ball in the intended spot such that the billiard balls go in the intended directions.

There are training aids available commercially for playing pool which help pool players aim their pool sticks so as to hit the cue ball at the correct angle, to determine at what angles to contact the other billiard balls, and at what angle the billiard balls must contact the side bumpers of the pool table for the billiard balls to go into the pockets. Such training aids include types which have movable mechanical pointers which pivot relative to one another to show incoming and outgoing shot angles, and types which are flat template sheets which are laid on the surface of the pool table indicating various angles at which to hit the balls.

While such training aids can assist a pool player in determining the correct angles at which to contact the balls and the side bumpers, the novice pool player is likely not to hit the balls as intended due to incorrect stroking of the pool stick at the cue ball. Such incorrect stroking can include rotating of the pool stick by the rearmost hand and wrist during the pool stroke such that the tip of the pool stick is rotating while contacting the cue ball. This applies rotational torque causing a slight spinning of such cue ball in a direction lateral to the intended direction of cue ball travel so as to send the cue ball slightly off the intended course of travel. Such rotation of the pool stick during a pool stroke also can result in the pool stick being aimed slightly off the intended direction and/or the tip of the pool stick contacting the cue ball at a point thereon not intended by the pool player such that the cue ball travels off course. While there is a need for a device which aids a pool player in improving his or her pool stroke including not rotating the pool stick during such pool stroke, applicant is not aware of any such billiards training devices.

SUMMARY OF THE INVENTION

The invention is a pool stick for training pool players to not rotate the pool stick during a pool stroke. The pool stick comprises an elongate body for the pool player to hold having a front and a rear body portion, and a shooting tip means preferably comprising a felt disk and a backing tubular member attached coaxially to an outermost tip portion of the front body portion. The outermost tip portion and tip means is laterally offset from an adjoining guide portion of the body, the remainder of the front body portion comprising an adjoining portion to the rear body portion. The rear body portion and adjoining portion, the guide portion, and the outermost tip portion have respective major, median, and minor longitudinal axes which extend therethrough. A first embodiment of the pool stick of the invention is a single section pool stick in accordance with the invention as described above.

During use the pool stick is slidingly supported by the frontmost hand of a pool player on the guide portion and by a rearmost hand gripping the rear body portion. Any rotation of the pool stick during a pool stroke occurs along an actual axis of rotation which extends through the guide portion where supported by the frontmost hand and through the rear body portion where supported by the rearmost hand, which actual axis does not pass through the tip means. Therefore, any rotation of the pool stick occurs along the actual axis which causes the tip means to move laterally rotationally about such actual axis which allows a pool player to visually detect such rotational movement of the pool stick relative to the billiard ball to be hit, to the pool table, and/or to the guide portion. Likewise, if the pool stick is held in position such that the major axis, median axis, and minor axis line up as viewed from above, rotation about the actual axis is visually apparent during a pool shot by such axes no longer lining up.

A second embodiment of the pool stick of the invention is a two section pool stick and a front section in accordance with the invention as described above, the front section being for use with commercially available rear sections as described above. As a two section pool stick, the front section comprises the front body portion with an outermost tip portion, guide portion, and adjoining portion, a tip means connected to the outermost tip portion, and a first element of a connecting means, preferably a male or female threaded bushing, disposed in a hole in the adjoining portion. The rear section comprises the rear body portion and a second element of the connecting means, preferably the mating male or female bushing to the first connecting element, disposed in a hole in the rear body portion. Pool sticks with more than two sections are also contemplated within the inventive concept with the various portions of the pool stick as described above forming the sections of the pool stick and connected together by connecting means such as described for the two section pool stick.

Numerous versions of the pool sticks of the invention are possible, with a preferred version being a two section pool stick having the rear body portion and adjoining portion of the front body portion laterally offset from the guide portion such that the tip means and outermost tip portion are coaxial with the rear body portion and adjoining portion with the median axis parallel to the major and minor axes. Other variations include, but are not limited to the following and various combinations thereof: the guide portion being coaxial with the rear body portion and the adjoining portion; the tip means and the outermost tip portion being laterally offset from the guide portion at a different distance than the lateral offset thereof from the rear body portion and adjoining portion; and the major axis, the median axis, and the minor axis being parallel or at an angle relative to the other axes.

THE DRAWINGS

Figure 6:
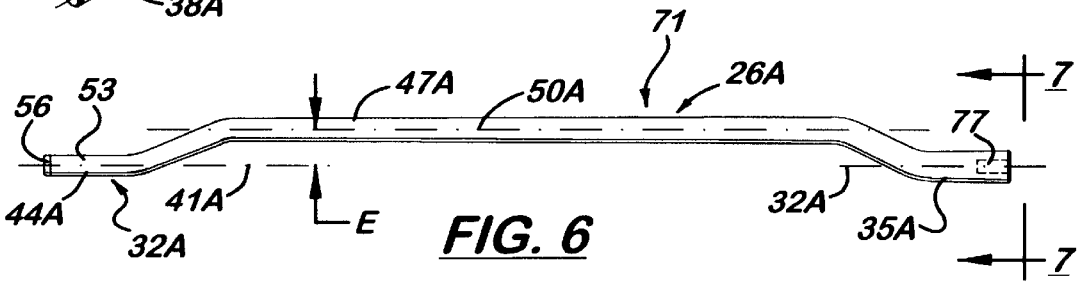
Figure 1:
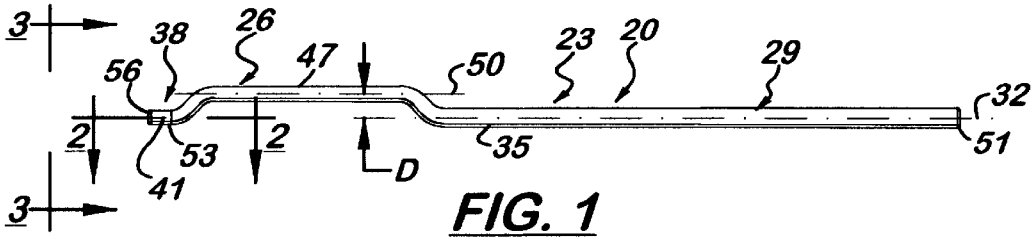
Figure 3:
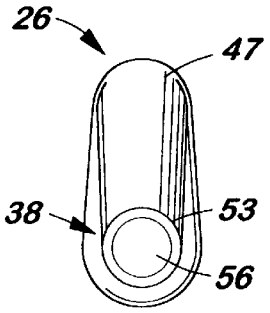
Figure 8:
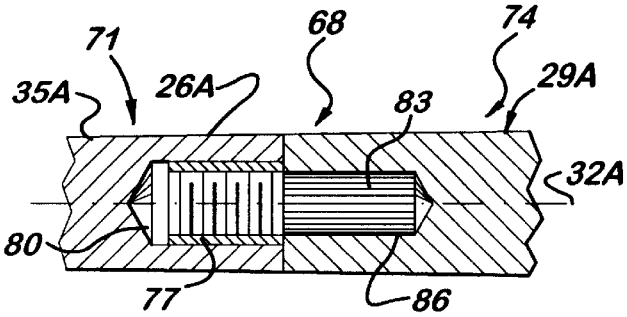
Figure 4:
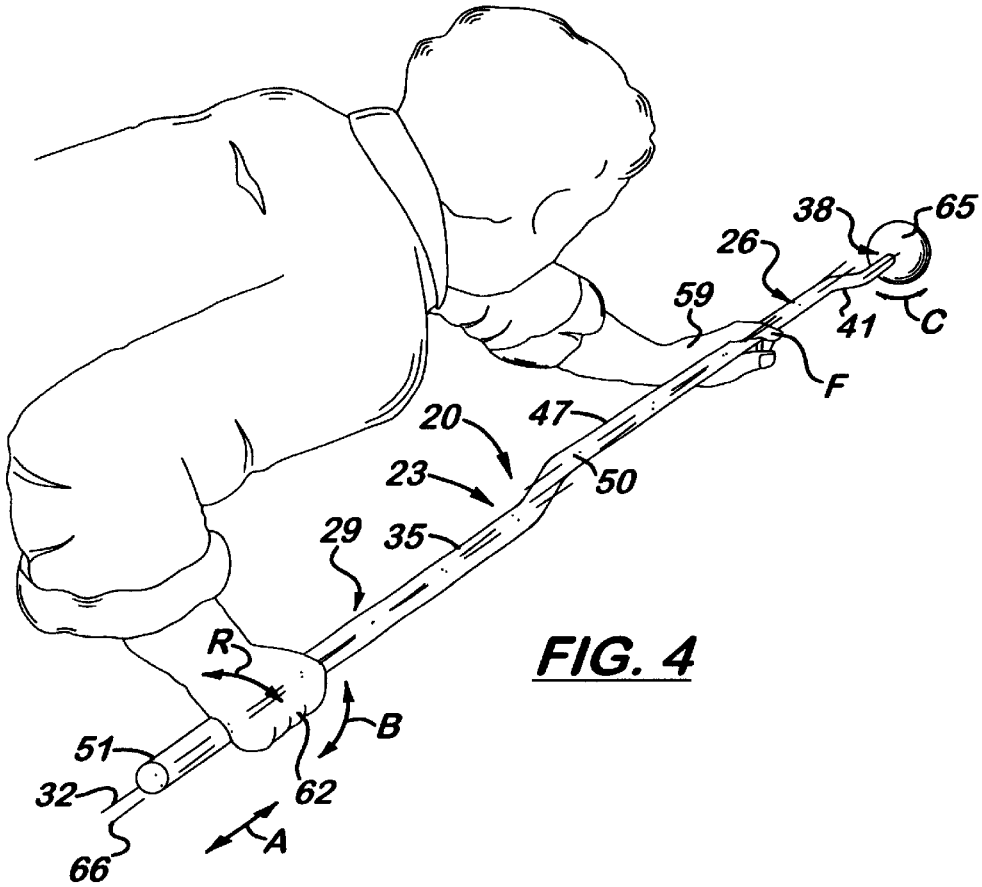
Figure 7:
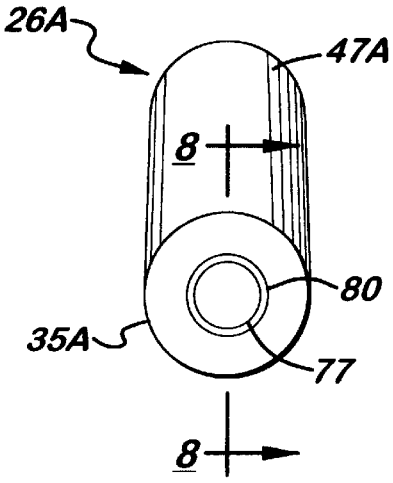
Figure 2:
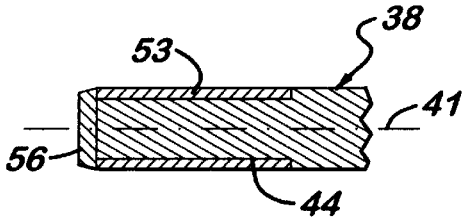

The best mode presently contemplated for carrying out the invention is illustrated in the accompanying drawings, in which:

FIG. 1 is a perspective view of a first embodiment of the invention comprising a single section pool stick;

FIG. 2, a fragmentary longitudinal horizontal sectional view taken on the line 2—2 of FIG. 1 to an enlarged scale showing tip means comprising a conventional pool stick tip;

FIG. 3, a front elevational view taken on the line 3—3 of FIG. 1 to an enlarged scale showing such conventional tip means and the offset of the outermost tip portion and tip means from the guide portion;

FIG. 4, a perspective view of such first embodiment pool stick as used by a pool player illustrating with arrows the longitudinal motion and rotation of such pool stick;

FIG. 5, a perspective view of a second embodiment of the invention comprising a two section pool stick having front and rear sections which screw together and a front section for a two piece pool stick;

FIG. 6, a side elevational view of such front section of the pool stick;

FIG. 7, a rear elevational view of such front section of the pool stick taken on the line 7—7 of FIG. 6 to an enlarged scale showing the threaded bushing for connection to a rear section of a pool stick;

FIG. 8, a fragmentary longitudinal vertical sectional view taken on the line 8—8 of FIG. 7 to the enlarged scale showing the connection of such front and rear sections of the pool stick, the rear section shown in phantom.

DETAILED DESCRIPTION OF THE ILLUSTRATED EMBODIMENTS

Shown in FIGS. 1, 2, 3, and 4 is a first embodiment of the invention, a single section pool stick 20 which comprises an elongate, tapered body 23 having an elongate, tapered front body portion 26 and an elongate, tapered rear body portion 29 each of generally circular cross-section for a majority of their length. A major longitudinal axis 32 extends through rear body portion 29 and an adjoining portion 35 of front body portion 26. Front body portion 26 includes an outermost end 38 having a minor longitudinal axis 41 and a reduced diameter, necked-down portion 44. Outermost end 38 is preferably coaxial with adjoining portion 35 and rear body portion 29. A laterally offset guide portion 47 connects outermost end 38 and adjoining portion 35 having a median longitudinal axis 50 therethrough which is preferably parallel with major longitudinal axis 32 and minor longitudinal axis 41 but offset by a distance "D", typically being from about one-half to one inch. A resilient rubber or other end bumper 51 can be affixed to rear body portion 29 to protect the free end thereof.

A conventional pool tip means, such as that shown in FIG. 2 comprising a tubular member 53, typically made of plastic or metal and of the same length as necked-down portion 44, closely fits about and is adhesively connected to necked-down portion 44, and a felt disk 56 which abuts and is adhesively connected to both outermost end 38 of front body portion 26 and to tubular member 53. Tubular member 53 and felt disk 56 are coaxial with outermost tip portion 38 and preferably with adjoining portion 35 and rear body portion 29. Other types of conventionally known tip means such as those with disks of various materials, such as plastics, with or without plastic or metal tubular members or other components, and with or without a necked-down portion are contemplated for use with the present invention.

Referring to FIG. 4, pool stick 20 is used by holding it in a shooting position wherein the guide portion 47 is slidably held in a pool player's frontmost hand 59 with the guide portion 47 preferably in a generally vertically up or down planar position, the up position being shown in FIG. 4, though any rotational orientation thereof can be used. The rear body portion 29 of the pool stick 20 is held in the pool player's rearmost hand 62. During a stroke of the pool stick 20, arrows "A", any rotational movement of the pool player's wrist 65, arrows "B", and associated rotation of pool stick 20 is readily apparent by means of tubular member 53 and felt disk 56 moving laterally rotationally, arrows "C", shown relative to a billiard ball 65. Such rotation occurs about an actual axis 66 which passes through a generally fixed point "R" of rear body portion 29 where rear body portion 29 is supported by rearmost hand 62, and through a longitudinally movable front point "F" of guide portion 47 where front body portion 26 is supported by frontmost hand 59 and about which actual axis 66 pivoting of pool stick 20 occurs. Actual axis 66 moves during a pool shot since the front point "F" moves along guide portion 47 as the pool stick 20 is moved relative to supporting frontmost hand 59, with rearmost hand 62 maintaining a generally fixed relationship to rear body portion 29 during a pool shot.

Shown in FIGS. 5, 6, 7, and 8 is a second embodiment of the invention, a two-section tapered pool stick 68 comprising front section 71 and rear section 74, front section 71 preferably being compatible for use with various commercially available rear sections for pool sticks. Front and rear sections 71 and 74 have a connecting means comprising a first connecting element, typically an internally threaded bushing 77 which is pressed into, adhesively fastened, and/or secured by other means within a hole 80 in front body portion 26A, and a second connecting element, typically an externally threaded bushing 83 pressed into, adhesively fastened, and/or secured by other means within a hole 86 in rear body portion 29A (FIG. 8). Such bushings 77 and 83 can also be reversed such that bushing 77 is secured to rear body portion 29A and bushing 83 secured to front body portion 26A.

The structure of front section 71 and rear section 74 of pool stick 68 is analogous to pool stick 20. Front section 71 includes an elongate tapered front body portion 26A and rear section 74 includes an elongate tapered rear body portion 29A, both of generally circular cross-section for a majority of their length. A major longitudinal axis 32A extends through rear body portion 29A and an adjoining portion 35A of front body portion 26A. Front body portion 26A includes an outermost end 38A having a minor longitudinal axis 41A and a reduced diameter, necked-down portion 44A. Outermost end 38A is preferably coaxial with adjoining portion 35A and rear body portion 29A. A laterally offset guide portion 47A connects outermost end 38A and adjoining portion 35A having a median longitudinal axis 50A therethrough which is preferably parallel with major longitudinal axis 32A and minor longitudinal axis 41A but offset by a distance "E", typically being from about one-half to one inch. A resilient rubber or other end bumper (not shown) can be affixed to rear body portion 29A to protect the free end thereof.

Conventional pool tip means comprises tubular member 53, which is the same length as a necked-down portion 44A, closely fits about and is adhesively connected to necked-down portion 44A, and felt disk 56 which abuts and is adhesively connected to both outermost end 38A of front body portion 23A and to tubular member 53. As such, preferably tubular member 53, and felt disk 56 are coaxial with adjoining portion 35A and rear body portion 29. Other types of conventionally known tip means stated above can be used.

The pool sticks of the invention can be adapted to have and include any of a number of conventional variations available without departing from the scope thereof including but not limited to: various tip means known in the industry; surface finishes such as powder painting and anodizing, surface decorations including etching; materials such as wood, aluminum, magnesium, steel, and alloys thereof, composites such as carbon fiber/graphite and fiberglass used with various resins, any of a number of widely known plastics; construction processes including bending, casting processes such as die casting; construction of solid, tubular, and other cross-sections, pool sticks having more than two separate sections for even further compactability, and pool sticks wherein the guide portion and/or other associated parts of the front section are included in the rear section or in other multiple sections. Scaled-down junior versions are contemplated of shorter length and lighter weight such as for use by children, smaller adults, and handicapped persons.

Other variations include but are not limited the following, combinations thereof, and combinations with the previously mentioned conventional variations: the various major, median, and minor axes being parallel, at various angles, or at various lateral offset distances relative to each other; the major and median axes being the same such that the handle body, the adjoining portion, and the guide portion are coaxial; no adjoining portion; the major and minor axes being the same such that the handle body, the adjoining portion, and the outermost end are coaxial; and the body portions being untapered, of other than generally circular cross-section, or of varying cross-sections along their length.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A pool stick for billiards training, comprising:

an elongate body having a front body portion and a rear body portion, with a major longitudinal axis which extends through said rear body portion and through at least an adjoining portion of said front body portion, said front body portion having a laterally offset, outermost tip portion with a minor longitudinal axis therethrough, a portion of said front body portion between said outermost tip portion and said adjoining portion of said rear body portion comprising a guide portion which is laterally offset relative to the adjoining portion of the front body portion and to the rear body portion, said guide portion having a median longitudinal axis therethrough, said major, minor, and median axes being parallel to one another, and wherein the outermost tip portion, the adjoining portion of the front body portion, and the rear body portion are coaxial;

a tip means attached to said outermost tip portion of said front body portion for contacting a billiard ball; and wherein a user grips said rear body portion with a rearmost hand and slidingly supports said front body portion with a frontmost hand on said guide portion, such that during a stroke of the pool stick any rotation is about a movable, actual axis which extends through a pair of movable support points through said guide portion and said rear body portion, respectively, where the frontmost and the rearmost hands, respectively, support the pool stick, said tip means not lying on said actual axis of rotation of the pool stick such that rotation of the pool stick about said actual axis causes lateral rotational movement of said tip means about said actual axis which is visible relative to said guide portion and to other references such as a billiard ball.

2. A pool stick for billiards training, comprising:

an elongate body having a front body portion and a rear body portion, with a major longitudinal axis which extends through said rear body portion and through at least an adjoining portion of said front body portion, said front body portion having a laterally offset, outermost tip portion with a minor longitudinal axis therethrough, a portion of said front body portion between said outermost tip portion and said adjoining portion of said rear body portion comprising a guide portion which is laterally offset relative to the adjoining portion of the front body portion and to the rear body portion, said guide portion having a median longitudinal axis therethrough, said major, minor, and median axes being parallel to one another, and wherein the outermost tip portion, the adjoining portion of the front body portion, and the rear body portion are coaxial;

a tip means attached to said outermost tip portion of said front body portion for contacting a billiard ball;

wherein said front body portion and the rear body portion are separate pieces which detachably connect together by a connecting means having a pair of mating connecting elements, one connecting element attached at respective ends of the front and rear body portions, said front body portion, tip means, and one of said connecting elements comprising a front shooting section, and said rear body portion and the other of said connecting elements comprising a rear handle section; and wherein a user grips said rear body portion with a rearmost hand and slidingly supports said front body portion with a frontmost hand on said guide portion, such that during a stroke of the pool stick any rotation is about a movable, actual axis which extends through a pair of movable support points through said guide portion and said rear body portion, respectively, where the frontmost and the rearmost hands, respectively, support the pool stick, said tip means not lying on said actual axis of rotation of the pool stick such that rotation of the pool stick about said actual axis causes lateral rotational movement of said tip means about said actual axis which is visible relative to said guide portion and to other references such as a billiard ball.

3. A front shooting section for a two section pool stick, which shooting section is adapted to removably connect to a conventional pool stick rear handle section comprising a rear body portion and a mating connecting means element so as to form in an assembled condition a two section pool stick for billiards training, the handle section having a major longitudinal axis which extends through the rear body Portion, comprising:

a front body portion having at opposite ends thereof an adjoining portion to the handle section through which the major longitudinal axis extends, and a laterally offset, outermost tip portion with a minor longitudinal axis therethrough, a portion of said body portion between said outermost tip portion and said adjoining portion comprising a guide portion which, with the pool stick in the assembled condition, is laterally offset relative to the adjoining portion of the front body portion and to the rear body portion, said guide portion having a median longitudinal axis therethrough, and with the two piece pool stick in the assembled condition, wherein said major, minor, and median axes are parallel, and wherein in the assembled condition the outermost tip portion, the adjoining portion of the front body portion, and the rear body portion are coaxial;

a tip means attached to said outermost tip portion of said body portion for contacting a billiard ball;

a connecting means element attached at an end of said adjoining portion which detachably connects to the mating connecting means element of the handle section to connect said shooting section to the handle section; and wherein in an assembled condition a user grips the rear body portion with a rearmost hand and slidingly supports said front body portion with a frontmost hand on said guide portion, such that during a stroke of the pool stick any rotation is about a movable, actual axis which extends through a pair of movable support points through said guide portion and said rear body portion where the frontmost and rearmost hands, respectively, support the pool stick, said tip means not lying on said actual axis of rotation of the pool stick such that rotation of the pool stick about said actual axis causes lateral rotational movement of said tip means about said actual axis which is visible relative to said guide portion and to other references such as a billiard ball.

* * * * *